US006644417B1

(12) United States Patent
Millican

(10) Patent No.: US 6,644,417 B1
(45) Date of Patent: Nov. 11, 2003

(54) QUICK REVERSE MECHANISM FOR PNEUMATIC BORING TOOL

(75) Inventor: Patrick E. Millican, Stillwater, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 10/247,094

(22) Filed: Sep. 18, 2002

Related U.S. Application Data

(63) Continuation of application No. 09/934,046, filed on Aug. 20, 2001, now Pat. No. 6,467,554.

(51) Int. Cl.[7] ..... E21B 4/14
(52) U.S. Cl. ..... 173/1; 173/91; 175/19
(58) Field of Search ..... 173/91, 1, 90, 173/128, 73; 175/19, 296

(56) References Cited

U.S. PATENT DOCUMENTS

| | | | | |
|---|---|---|---|---|
| 3,744,576 | A | 7/1973 | Sudnishnikov et al. | 173/91 |
| 3,756,328 | A | 9/1973 | Sudnishnikov et al. | 173/91 |
| 3,891,036 | A | 6/1975 | Schmidt | 173/91 |
| 4,132,277 | A | 1/1979 | Tupitsyn et al. | 175/19 |
| 4,250,972 | A | 2/1981 | Schmidt | 173/91 |
| 4,284,147 | A | 8/1981 | Jenne | 173/91 |
| 4,662,457 | A | 5/1987 | Bouplon | 173/91 |
| 4,683,960 | A | 8/1987 | Kostylev et al. | 173/91 |
| 4,907,658 | A | 3/1990 | Stangl et al. | 175/19 |
| 5,086,848 | A | 2/1992 | Hudak | 173/1 |
| 5,117,922 | A | 6/1992 | Baron | 173/91 |
| 5,172,771 | A | 12/1992 | Wilson | 173/1 |
| 5,226,487 | A | 7/1993 | Spektor | 175/19 |
| 5,311,950 | A | 5/1994 | Spektor | 175/19 |
| 5,327,636 | A | 7/1994 | Wilson | 29/525 |
| 5,337,837 | A | 8/1994 | Wentworth et al. | 175/19 |
| 5,467,831 | A * | 11/1995 | Spektor | 173/91 |
| 5,505,270 | A | 4/1996 | Wentworth | 173/1 |
| 5,511,626 | A | 4/1996 | Steen | 175/19 |
| 5,603,383 | A | 2/1997 | Wentworth et al. | 173/91 |
| 5,680,904 | A | 10/1997 | Patterson | 173/13 |
| 5,687,803 | A | 11/1997 | Wentworth et al. | 175/19 |
| 5,860,481 | A | 1/1999 | Prokop et al. | 173/207 |
| 5,915,483 | A | 6/1999 | Gien | 173/91 |
| 5,918,687 | A | 7/1999 | Prater, Jr. et al. | 173/91 |
| 5,934,383 | A | 8/1999 | Jurgens et al. | 173/91 |
| 5,944,117 | A | 8/1999 | Burkholder et al. | 173/91 |
| 5,954,145 | A | 9/1999 | Hesse et al. | 175/19 |
| 5,957,226 | A | 9/1999 | Holte | 175/320 |
| 6,003,606 | A | 12/1999 | Moore et al. | 166/381 |
| 6,047,778 | A | 4/2000 | Coffman et al. | 175/296 |
| 6,050,346 | A | 4/2000 | Hipp | 173/91 |
| 6,269,889 | B1 * | 8/2001 | Wentworth | 173/91 |
| 6,371,220 | B1 * | 4/2002 | Hesse et al. | 175/19 |

* cited by examiner

*Primary Examiner*—Scott A. Smith
(74) *Attorney, Agent, or Firm*—McKinney & Stringer, P.C.

(57) ABSTRACT

A reversible impact-operated pneumatic boring tool for reversing the direction of operation of the tool is disclosed. The tool includes two fluid supply lines, a striker and a non-mechanically biased directional control sleeve. The primary fluid supply line provides pressurized fluid for striker reciprocation within the tool body to drive the tool through the soil. The secondary fluid supply line provides pressurized fluid to determine direction of operation of the tool. Pressurized fluid is supplied to a sealed chamber behind the directional control sleeve to drive the sleeve forward and operate the tool in a forward mode. The control sleeve is held forward solely by maintaining sufficient positive pressure of the fluid in the-sealed chamber. Whereas, the depressurization of the chamber solely, will cause the sleeve to be moved to a rearward position thereby causing the tool to operate in the reverse mode.

34 Claims, 8 Drawing Sheets

QUICK REVERSE MECHANISM FOR PNEUMATIC BORING TOOL

CROSS-REFERENCE TO RELATED APPLICATION

This Application is a continuation of U.S. patent application Ser. No. 09/934,046, filed Aug. 20, 2001, now U.S Pat. No. 6,467,554, the contents of which are incorporated herein by reference.

FIELD OF THE INVENTION

The present invention relates to boring tools for underground boring, and more particularly, it relates to pneumatic impact operated boring tools for use with horizontal boring machines during horizontal boring operations for placement of utility lines and the like.

BACKGROUND OF THE INVENTION

Pneumatic impact-operated boring tools are well-known in the art. U.S. Pat. No. 3,756,328 issued to Sudnishnikov et al. discloses one such device. Typically, pneumatic impact-operated boring tools are used for burrowing holes in soil, particularly horizontal or near horizontal passages for installation of utility lines when trenching is undesirable. An example of such usage would be for the installation of services underneath an existing structure, such as a driveway or highway, where installation of the line by traditional open cut methods would be impractical. In this situation, the pneumatic impact-operated boring tool is launched from a pit on one side of the structure and is advanced to a receiving pit on the opposite side of the structure.

As the name implies, such boring tools function by impact. The tools possess a striking member (striker) slidable within a cylindrical housing. The striker delivers impacts on a surface at the front end of the housing. This impacting motion within the tool itself causes the soil around the tool to compact away from the nose of the housing, thus forming a hole. The tools are typically driven by a compressed air source. As the compressed air flows through the tool, the striker will be driven in a reciprocal motion generating a series of rapid impacts against the front of the tool housing, causing it to be driven through the ground.

Utility service lines to be installed may either be inserted into the hole formed by the piercing tool, or may be pulled into the hole behind the tool as it operates. Alternatively, pneumatic piercing tools have also been used to install rigid service lines such as steel lines by driving the steel lines into place.

It is occasionally desirable to retract the piercing tools from the borehole being formed. For example, if the piercing tool encounters an obstruction in the soil such as a rock or stone or deviates from the desired path or is damaged in any way, quick withdrawal of the tool from the borehole may be necessary. Most tools are designed to facilitate this retraction by having a mode wherein the striker impacts the rear of the tool causing a retrograde progression of the tool within the borehole.

Thus, reversible impact-operated boring tools are also well-known in the art. U.S. Pat. No. 4,683,960 issued to Kostylev et al. discloses such a device. The prior art discloses various means for accomplishing the reverse motion. In the older designs, the shift from the forward operation mode of the tool to the reverse/withdraw mode is accomplished in any one of the following ways. Some require interrupting the pressurized fluid supply. Others require manipulation of the hose supplying the pressurized fluid to the tool, either by rotating the hose or by pulling it back. Still others require both the interruption of the pressurized fluid supply and the manipulation of the hose.

However, there are several disadvantages associated with these processes. For example, when the pressurized fluid supply is interrupted and the tool is therefore momentarily shut off, the tool may not restart when the pressurized fluid supply is recommenced. In tools requiring hose manipulation, when the hose is flexible, it is often difficult to relate the degree of rotational motion of the hose at the surface to the degree of rotational motion at the tool itself, which may be some distance away. In addition, cave-ins of the hole wall can bind the hose, making it difficult to rotate the hose, or preventing it altogether. Consequently, it is often difficult to reverse the operation of the tool, or to be certain of the direction of operation.

In the more recent designs, the mechanism of shifting the pneumatic tool from forward to reverse is somewhat simplified. U.S. Pat. Nos. 5,172,771 ('771 patent) and 5,327,636 ('636 patent), both issued to Wilson and both incorporated fully herein by reference, disclose such a device. In Wilson's '771 patent, a second air hose was added to act as a control mechanism for switching the tool from forward to reverse. Pressurizing the control hose caused a valve mechanism in the tool to move to a forward position, creating the forward movement of the pneumatic tool. Releasing the pressurized air from the control hose caused the valve mechanism to move to a rearward position, resulting in a reverse/withdrawal movement of the tool. However, the valving mechanism in the tool of the '771 patent is complex, and difficult to assemble, requiring assembly of several parts such as a pre-load spring, snap ring, etc. for valve containment. Additionally, the valving mechanism of the '771 patent is rigid in terms of deflection perpendicular to the longitudinal axis of the tool body. This inherent rigidity of the valving member makes the tool more prone to stalling if the tool body is deflected along its longitudinal axis by contact with an underground obstacle.

Due to the complexity presented by the current means for the reversing operation of impact-operated boring tools, and the increased labor and time associated with servicing the various component parts, an alternate simpler mechanism for switching a pneumatic piercing tool from forward to reverse operation is needed.

SUMMARY OF THE INVENTION

In one aspect, the invention relates to an impact-operated, ground-penetrating tool powered by a primary supply of pressurized fluid, and controlled between a forward operating mode and a reverse operating mode by a second supply of pressurized fluid. The tool comprises a housing, a striker, a manifold, a primary inlet tube, a valve chamber, and a control sleeve. The housing has a front end, a rear end, and body. The body of the housing defines an interior operating chamber with an inner surface, an exhaust conduit to provide fluid communication between the interior operating chamber and the outside of the tool, a forward striker surface, and a rearward striker surface.

The striker is reciprocally supported within the interior operating chamber of the housing between the forward and rearward striker surfaces. The striker has a forward end, a rear portion terminating in a rear end, and a striker body defining an interior striker chamber. The rear portion of the striker sealingly engages the inner surface of the interior operating chamber to divide the operating chamber into a forward operating chamber and a rearward operating chamber. The rearward operating chamber is continuous with the exhaust conduit. The striker body has at least one striker port to provide fluid communication between the forward operating chamber of the housing and the interior striker chamber.

The manifold is located near the rear end of the housing and comprises a primary conduit connectable to the primary fluid supply and a secondary conduit connectable to the secondary fluid supply. A primary fluid inlet tube extends from the primary conduit of the manifold. Additionally, the valve chamber comprises a front valve chamber and a rear valve chamber, the rear valve chamber being in fluid communication with the secondary conduit in the manifold.

The control sleeve has a rear portion terminating in a rear end, a front portion, and an interior sleeve chamber defining a passage between the rear portion and the front portion. The front portion of the control sleeve is slidably and sealingly supported inside the rear portion of the striker. The rear portion of the control sleeve is slidably and sealingly supported on the primary fluid inlet tube at least partially inside the valve chamber. The control sleeve provides continuous fluid communication between the primary fluid inlet tube and the interior striker chamber, so that in response to supply of primary fluid the striker reciprocates between a forward position and a rearward position. In the forward position, the striker port is open between the interior striker chamber and the forward operating chamber. In the rearward position, the striker port is open between the forward operating chamber and the rearward operating chamber and the exhaust conduit.

Finally, the rear portion of the control sleeve includes a nodular lobe inside the valve chamber that sealingly engages an inner wall of the valve chamber and divides the valve chamber into the front valve chamber and the rear valve chamber. The nodular lobe of the rear portion of the control sleeve is movable between a forward position in response to pressurization of the rear valve chamber and a rearward position in response to depressurization of the rear valve chamber. This causes the front portion of the control sleeve to move between a forward position in which the striker hits the forward striker surface as it reciprocates and a rearward position in which the striker hits the rearward striker surface as it reciprocates.

In another aspect, the invention relates to an impact-operated, ground-penetrating tool powered by a primary supply of pressurized fluid, and controlled between a forward operating mode and a reverse operating mode by a second supply of pressurized fluid. The tool comprises a housing, a striker, a means for operably connecting the primary fluid supply, a valve chamber, a means for operably connecting the secondary fluid supply and a control sleeve. The housing has a front end, a rear end, and body. The body defines an interior operating chamber with an inner surface, an exhaust conduit providing communication between the interior operating chamber and the outside of the tool, a forward striker surface and a rearward striker surface.

A striker is reciprocally supported within the interior operating chamber of the housing between the forward and rearward striker surfaces. The striker has a forward end, a rear portion terminating in a rear end, and a striker body defining an interior striker chamber. The rear portion of the striker sealingly engages the inner surface of the interior operating chamber to divide the interior operating chamber into a forward operating chamber and a rearward operating chamber. The rearward operating chamber is continuous with the exhaust conduit and the striker body has at least one striker port to provide fluid communication between the forward operating chamber and the interior striker chamber.

The means for operably connecting the primary fluid supply connects the primary fluid supply to the interior striker chamber. Additionally, the means for operably connecting the secondary fluid supply connects the secondary fluid supply to the valve chamber at the rear end of the housing.

The control sleeve has a rear portion terminating in a rear end, and a front portion. The front portion of the control sleeve is slidably and sealingly supported inside the rear portion of the striker. The rear portion of the control sleeve is slidably and sealingly received at least partially inside the valve chamber. The control sleeve provides continuous fluid communication between the means for operably connecting the primary fluid supply and the interior striker chamber. As a result, in response to supply of primary fluid the striker reciprocates between a forward position and a rearward position. In the forward position, the striker port is open between the interior striker chamber and the forward operating chamber. In the rearward position, the striker port is open between the forward operating chamber and the rearward operating chamber and the exhaust conduit.

Finally, the rear portion of the control sleeve includes a nodular lobe inside the valve chamber that sealingly engages an inner wall of the valve chamber and divides the valve chamber into the front valve chamber and the rear valve chamber. The nodular lobe of the rear portion of the control sleeve is movable between a forward position in response to pressurization of the rear valve chamber and a rearward position in response to depressurization of the rear valve chamber. This causes the front portion of the control sleeve to move between a forward position in which the striker hits the forward striker surface as it reciprocates, and a rearward position in which the striker hits the rearward striker surface as it reciprocates.

In yet another aspect, the invention is an impact-operated, ground-penetrating tool powered by a primary supply of pressurized fluid, and controlled between forward operating mode and a reverse operating mode by a second supply of pressurized fluid. The tool comprises a housing, a striker, a primary connecting assembly, a valve chamber, a secondary connecting assembly and a control sleeve. The housing having a front end, a rear end, and body defining an interior operating chamber with an inner surface, an exhaust conduit providing communication between the interior operating chamber and the outside of the tool, a forward striker surface, and a rearward striker surface.

A striker is reciprocally supported within the interior operating chamber of the housing between the forward and rearward striker surfaces. The striker has a forward end, a rear portion terminating in a rear end, and a striker body defining an interior striker chamber. The rear portion of the striker sealingly engages the inner surface of the interior operating chamber to divide the interior operating chamber into a forward operating chamber and a rearward operating chamber. The rearward operating chamber is continuous with the exhaust conduit and the striker body has at least one striker port to provide fluid communication between the forward operating chamber and the interior striker chamber.

The primary connecting assembly operably connects the primary fluid supply to the interior striker chamber. The valve chamber is located at the rear end of the housing and comprises a front valve chamber and a rear valve chamber.

The secondary connecting assembly operably connects the secondary fluid supply to the rear valve chamber. The control sleeve has a rear portion terminating in a rear end, and a front portion.

The front portion of the control sleeve is slidably and sealingly supported inside the rear portion of the striker. The rear portion of the control sleeve is slidably and sealingly received at least partially inside the valve chamber. The sleeve provides continuous fluid communication between primary connecting assembly and the interior striker chamber. As a result, in response to supply of primary fluid the striker reciprocates between a forward position and a rearward position. In the forward position, the striker port is open between the interior striker chamber and the forward operating chamber. In the rearward position, the striker port is open between the forward operating chamber and the rearward operating chamber and the exhaust conduit.

Finally, the rear portion of the control sleeve includes a nodular lobe inside the valve chamber that sealingly engages an inner wall of the valve chamber and divides the valve chamber between the front valve chamber and the rear valve chamber. The nodular lobe of the rear portion of the control sleeve is movable between a forward position in response to pressurization of the rear valve chamber and a rearward position in response to depressurization of the rear valve chamber. This causes the front portion of the control sleeve to move between a forward position in which the striker hits the forward striker surface as it reciprocates, and a rearward position in which the striker hits the rearward striker surface as it reciprocates.

In another aspect, the invention is a reversible impact ground penetrating boring tool comprising a housing, a striker, a primary fluid supply assembly, a control sleeve, and a secondary fluid supply assembly. The housing has a rear end, and an interior chamber defining a forward striker surface and a rearward striker surface.

The striker has an external wall surrounding an interior striker chamber. The striker is slidably and sealingly receivable within the interior chamber of the housing and is adapted to reciprocally move between the forward striker surface and the rearward striker surface. The external wall of the striker and the interior chamber of the housing define an operating chamber. The primary fluid supply assembly is operably connectable to the striker and is adapted to provide pressurized primary fluid to the interior striker chamber. As a result, the striker will be driven in a reciprocal motion within the interior chamber of the housing when the pressurized primary fluid is supplied.

The control sleeve has a front portion, a rear portion terminating in a rear end, and an interior sleeve chamber defining a passage from the front portion to the rear portion. The valve fluid chamber is configured to have a first end and a second end and comprises a front valve chamber toward the first end and a rear valve chamber toward the second end. The front portion of the control sleeve is slidably and sealingly receivable within the interior striker chamber. The rear portion of the control sleeve is slidably and sealingly receivable within the valve fluid chamber at the rear end of the tool housing such that the rear portion of the control sleeve engages an inner wall of the valve chamber and divides the valve chamber between the front valve chamber and the rear valve chamber.

The rear portion of the control sleeve is adapted to move toward the first end of the valve fluid chamber during tool advancement. The rear portion of the control sleeve is adapted to move toward the second end of the valve fluid chamber during tool withdrawal. Additionally, the striker will impact the forward striker surface when the control sleeve is at the first end of the valve fluid chamber and the rearward striker surface when the control sleeve is at the second end of the valve fluid chamber.

The secondary fluid supply assembly is operably connectable to the rear valve fluid chamber. The rear valve fluid chamber is pressurized by the secondary fluid supply assembly. The rear valve fluid chamber is pressurized to move and hold the sleeve at the first end during tool advancement and the rear valve fluid chamber is depressurized to permit the control sleeve to move toward and remain at the second end during tool withdrawal.

In yet another aspect, the invention is an impact-operated, ground-penetrating drill assembly. The drilling assembly comprises a boring tool, a primary fluid supply system, and a secondary fluid supply system. The primary fluid supply system is adapted to supply pressurized fluid to power movement of the boring tool. The secondary fluid supply system is adapted to supply pressurized fluid to control movement of the boring tool between a forward operating mode and a reverse operating mode.

The boring tool comprises a housing, a striker, a manifold, a primary fluid inlet tube, a valve chamber, and a control sleeve. The housing has a front end, a rear end, and body defining an interior operating chamber with an inner surface and an exhaust conduit. The exhaust conduit provides communication between the operating chamber and the outside of the tool. Additionally, the housing comprises a forward striker surface, and a rearward striker surface.

The striker is reciprocally supported within the operating chamber of the housing between the forward and rearward striker surfaces. The striker has a forward end, a rear portion terminating in a rear end, and a striker body defining an interior striker chamber. The rear portion of the striker sealingly engages the inner surface of the operating chamber to divide the operating chamber into a forward operating chamber and a rearward operating chamber. The rearward operating chamber is continuous with the exhaust conduit. Additionally, the striker body has at least one striker port to provide fluid communication between the forward operating chamber and the interior striker chamber.

The manifold is located near the rear end of the housing and comprises a primary conduit connectable to the primary fluid supply system and a secondary conduit connectable to the secondary fluid supply system. The primary fluid inlet tube extends from the primary conduit of the manifold. Further, the valve chamber is configured to have a front valve chamber and a rear valve chamber. The rear valve chamber is in fluid communication with the secondary conduit in the manifold. The control sleeve has a rear portion, a front portion, and an interior sleeve chamber defining a passage between the rear portion and the front portion. The front portion of the control sleeve is slidably and sealingly supported inside the rear portion of the striker. The rear portion of the control sleeve is slidably and sealingly supported on the primary fluid inlet tube at least partially inside the valve chamber.

The control sleeve provides continuous fluid communication between the primary fluid inlet tube and the striker chamber. As a result, in response to a supply of primary fluid the striker reciprocates between a forward position in which the striker port is open between the interior striker chamber and the forward operating chamber and a rearward position in which the striker port is open between the forward operating chamber and the rearward operating chamber and exhaust conduit.

Finally, the rear portion of the sleeve includes a nodular lobe inside the valve chamber that sealingly engages an inner wall of the valve chamber and divides the valve chamber into the front valve chamber and the rear valve chamber. The nodular lobe of the rear portion of the control sleeve is movable between a forward position in response to pressurization of the rear valve chamber and a rearward position in response to depressurization of the rear valve chamber. As a result, the front portion of the sleeve moves between a forward position in which the striker hits the forward striker surface as it reciprocates and a rearward position in which the striker hits the rearward striker surface as it reciprocates.

In another aspect, the invention is a method of using an impact-operated, ground penetrating tool for a boring operation. The tool has a valve chamber and an interior striker chamber and a valve chamber. The valve chamber is configured to have a front valve chamber and a rear valve chamber. The method comprises operating the tool in a forward operating mode, maintaining the tool in the forward operating mode, and operating the tool in the reversed operating mode.

The tool is operated in the forward operating mode by substantially simultaneously pressurizing the rear valve chamber and the interior striker chamber with fluid. The tool is maintained in the forward operating mode by solely by pressurization of the rear valve chamber. Finally, the tool is operated in the reverse operating mode by substantially simultaneously pressurizing the interior striker chamber and depressurizing the rear valve chamber.

In still another aspect, the invention is an impact-operated ground-penetrating tool for use with a primary supply of pressurized fluid and a secondary supply of pressurized fluid. The tool comprises a housing, a striker, a valve chamber, and a control sleeve. The housing has a front end, a rear portion, and an interior operating chamber with a forward striker surface and a rearward striker surface. The rear portion of the housing includes a primary inlet adapted to receive the primary supply of pressurized fluid and a secondary inlet adapted to receive the secondary supply of pressurized fluid.

The striker is slidably and sealingly supported inside the operating chamber for reciprocal movement therein between the forward striker surface and the rearward striker surface. The striker has a forward impact surface adapted to impact the forward striker surface whereby the tool is operable in the forward mode. Additionally, the striker has a rear impact surface adapted to impact the rearward striker surface whereby the tool is operable in the rearward mode. The striker further comprises a rear end and an interior striker chamber opening at the rear end and ending a distance from the rear end.

The valve chamber in formed in the rear portion of the housing and is configured to have a first end and a second end, and comprises a front valve chamber and a rear valve chamber. The front valve chamber is toward the first end and the rear valve chamber is toward the second end. The rear valve chamber is in fluid communication with the secondary inlet. The control sleeve has a front portion terminating in an open front end defining a primary fluid surface. Additionally, the control sleeve has a rear portion terminating in an open rear end defining a secondary fluid surface. Further, the control sleeve has a sleeve passage therethrough continuous with the front end and the rear end thereof.

The rear portion of the control sleeve is sealingly and slidably supported inside the valve chamber such that the rear portion of the control sleeve engages an inner wall of the valve chamber and divides the valve chamber into the front valve chamber and the rear valve chamber, for movement therein in response to pressure in the rear valve chamber from the secondary supply of pressurized fluid. The control sleeve is movable between a forward position in which the rear portion approaches the first end of the valve chamber and a rearward position in which the rear portion approaches the second end of the valve chamber. The sleeve passage is in constant fluid communication with the primary inlet.

The rear portion of the striker is slidingly and sealingly supported on the front portion of the control sleeve so that the interior striker chamber is in fluid communication with the sleeve passage whereby the striker is movable in response to pressure from the primary supply of pressurized fluid. Additionally, the rear portion of the striker comprises a fluid port to provide fluid communication between the interior striker chamber and the operating chamber. The port is positioned so that when the control sleeve is in the forward position the striker operates in the forward mode and so that when the control sleeve is in the reverse position the striker operates in the rearward mode.

The primary fluid surface on the control sleeve is adapted to receive pressure from the primary supply of pressurized fluid in the striker chamber to move the control sleeve toward the rearward position. Additionally, the secondary fluid surface is adapted to receive pressure from the secondary supply of pressurized fluid in the valve chamber to move the control sleeve toward forward position. However, a cross-sectional area of the secondary fluid surface taken perpendicular to the longitudinal axis of the control sleeve is greater than a cross-sectional area of the primary fluid surface taken perpendicular to the longitudinal axis of the control sleeve so that pressure from the secondary fluid acting on the secondary fluid surface is sufficient to overcome the pressure of the primary fluid on the primary fluid surface and maintain the control sleeve in the forward position.

BRIEF DESCRIPTION OF THE DRAWINGS

For a more complete understanding of the present invention, and the advantages thereof, reference is now made to the following description, taken in conjunction with the accompanying drawings, in which:

FIG. 6 is a longitudinal partly cross-sectional view of the tool assembly of FIG. 1 constructed in accordance with the present invention illustrating the boring tool in the reverse mode with the striker away from the rearward striker surface.

FIG. 9 is a partly exploded cross-sectional view of the tool assembly of FIG. 1 constructed in accordance with the present invention to better display the components of the tool assembly housed within the outer housing.

DESCRIPTION OF THE PREFERRED EMBODIMENTS

Typically, the reversible impact-operated boring tool includes a hollow outer body that consists of a torpedo-shaped front end and a coaxial tailpiece. A fluid driven piston-like striker reciprocates lengthwise in the hollow body between the front end and the coaxial tailpiece. If the striker impacts the front end of the hollow body, the tool will be driven forward. Conversely, if the striker impacts the tailpiece, the reverse motion results. However, the determining factor on whether the striker will impact the front or the rear of the tool as it cycles back and forth is the position of a fluid actuated control sleeve. When the control sleeve is in the rearward position, the striker will impact the tail piece for reverse motion of the tool. When the control sleeve is in a forward position, the striker will impact the front of the tool for forward motion.

Figure 1:
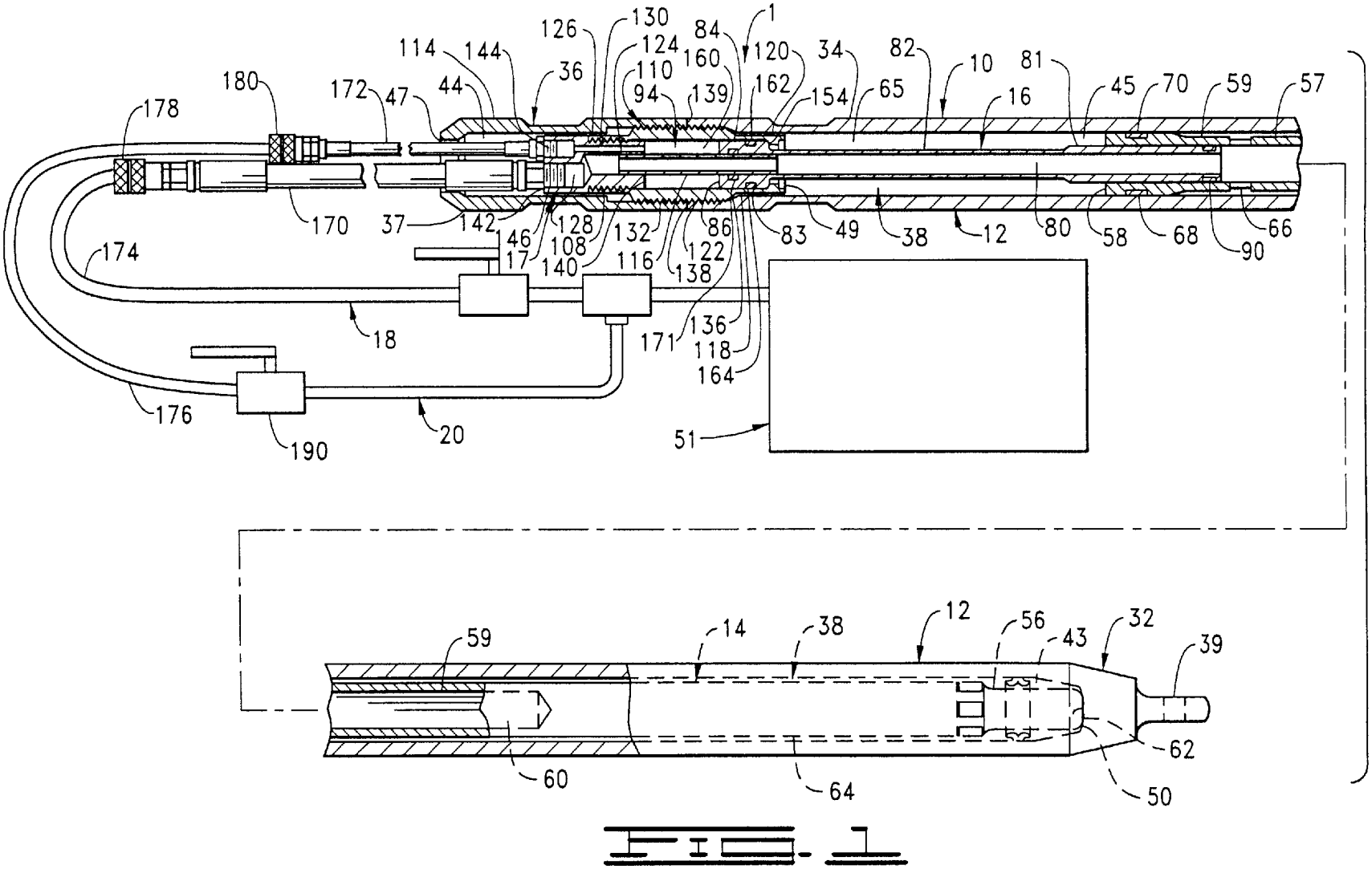
FIG. 1 is a diagrammatic representation of the reversible impact-operated boring tool assembly with a longitudinal party cross-sectional view of the tool assembly constructed in accordance with the present invention.
Figure 2:
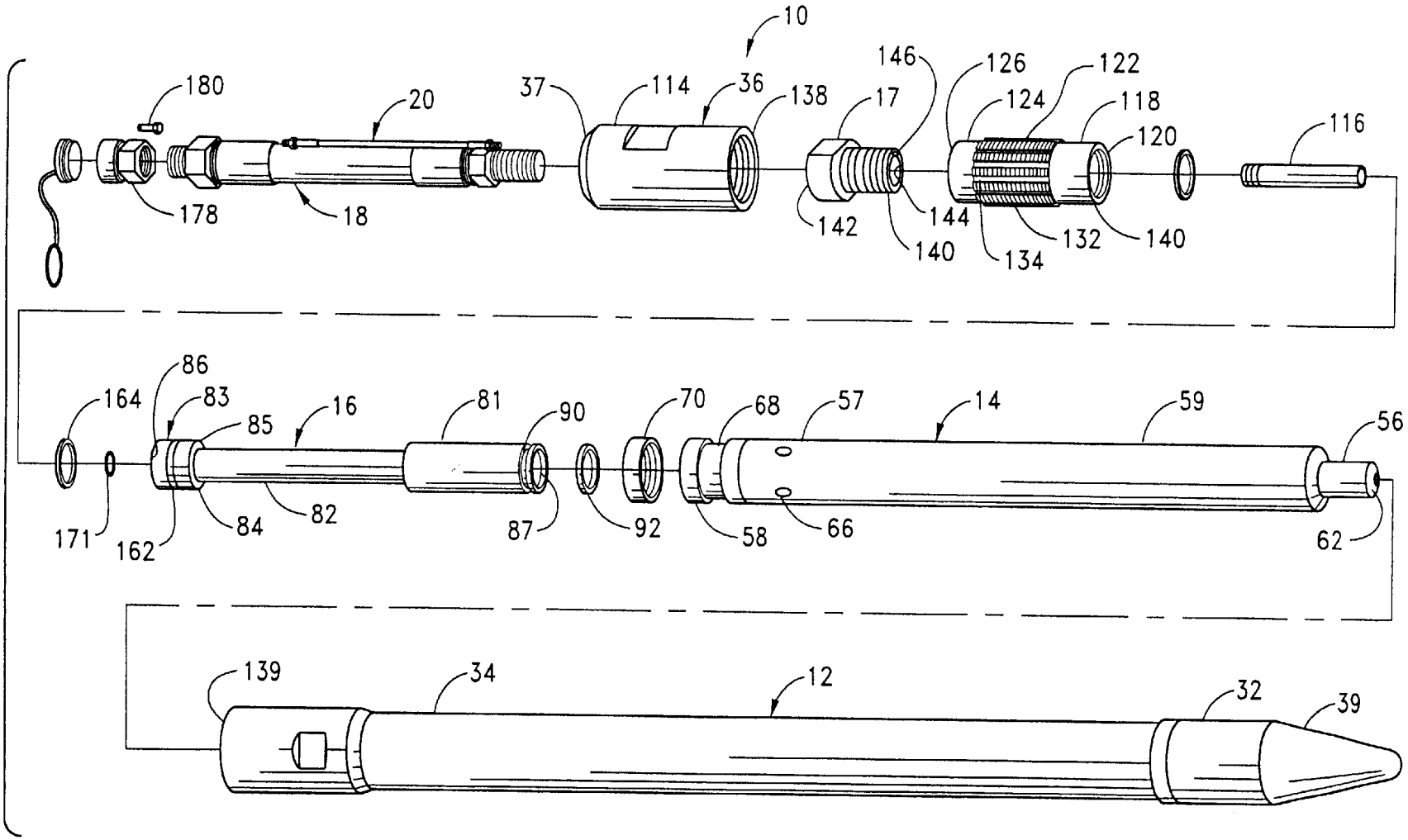
FIG. 2 is an exploded view of the tool assembly of FIG. 1 showing the component parts of the reversible impact-operated boring tool.

Turning now to the drawings in general and FIGS. 1 and 2 in particular, there is shown therein a pneumatic reverse impact-operated boring tool assembly 1 in accordance with the present invention. The boring tool, designated by the reference numeral 10, generally comprises an outer housing 12, striker 14, control sleeve 16, a manifold such as a manifold nut 17, and two fluid supply assemblies 18 and 20 respectively (FIG. 1).

With reference to FIGS. 1 and 2, the outer housing 12 preferably comprises a missile shaped front end 32, a body 34, and a tail piece assembly 36. The tail piece assembly 36 is connected to the body 34 to form the rear portion of the housing and terminates in a rear end 37. Additionally, the outer housing 12 defines a hollow interior operating chamber 38. (FIG. 1) The outer housing 12, is generally made of a durable metal such as steel, ductile iron, or titanium, with an outside diameter generally ranging between 2–8 inches, and an overall length generally between 2.5–5 feet. However, the outer housing 12, may be made with any other durable material in varying lengths and diameter. Preferably, the outer housing 12 is a two-piece assembly joined by friction welding. Utilizing a friction welded outer housing 12 results in a less expensive outer body as compared to machining the body out of a single piece of steel. Additionally, the friction weld forms a full cross section weld with strength comparable to the original material. It should be noted, however, that the outer housing 12 may be made of a single, machined piece of steel or any other durable metal without departing from the spirit of the invention.

Figure 7:
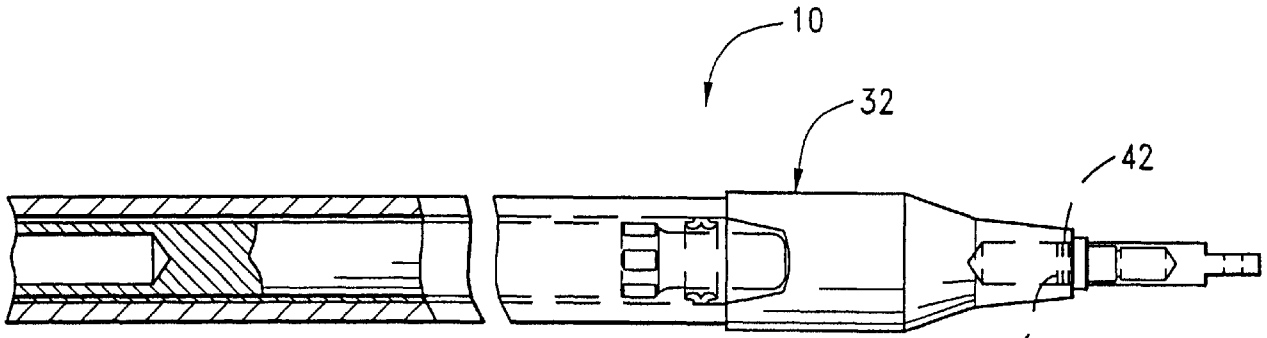
FIG. 7 is a longitudinal partly cross-sectional view of the tool assembly of FIG. 1 constructed in accordance with the present invention illustrating an end of the tool body adapted to receive replaceable nose pieces.

In the preferred embodiment, the missile shaped front end 32 of the outer housing 12 comprises a nose piece 39 (FIG. 1) to act as the first point of contact for the tool against the surrounding soil as illustrated in FIG. 7. The front end 32 of the outer housing 12 may be adapted to receive different types of nose pieces. It will be appreciated that the different types of nose pieces may take different shapes. The shape of the nose piece may be varied to accommodate boring through different types of soils. For example, a tapered head nose piece may be attached when boring in wet, spongy or loose soil conditions where no obstructions are anticipated. Alternatively, a stepped head nose piece for boring through roots and small rocks, or a splined stepped head for hard, dry, compacted soils where obstacles may be encountered may be used. Preferably, as illustrated in FIG. 7, the front end 32 of the outer housing 12, has a recessed thread 40 for receiving an adapter stud 42. The adapter stud 42 receives the replaceable nose pieces discussed above. Alternatively, an electronic transmitter housing as discussed in U.S. Pat. No. 4,907,658 by Stangl et al. the contents of which are incorporated fully herein by reference, may be used on the front end 32 of the tool outer housing 12.

With reference to FIG. 1, the interior operating chamber 38 of the outer housing 12 preferably defines a closed front end 43 corresponding with the front end 32 of the outer housing 12, an open rear end 44 corresponding with the rear end 37 of the outer housing and a body 45 in between defining an inner surface. An exhaust conduit 47 (described in more detail later) is provided at the rear end 44 of the interior operating chamber 38 between the inner surface of the rear portion of the outer housing 12 and the fluid assemblies 18 and 20, respectively for fluid communication between the interior operating chamber 38 and the outside of the boring tool 10. Additionally, the open rear end 44 of the interior operating chamber 38, preferably receives a front end 48 of the tail piece assembly 36, forming a rearward striker surface 49 for the piston or striker 14 as will be discussed in detail later. Further, the closed front end 43 of the interior operating chamber 38, preferably defines a forward striker surface 50 for the piston or striker 14.

In the preferred embodiment illustrated in FIGS. 1 and 2, the striker 14 is slidably and sealingly receivable within the interior operating chamber 38 and is driven by an external compressed fluid supply system 51 (FIG. 1). The compressed fluid from the fluid supply system 51 causes the striker 14 to reciprocally move within the interior operating chamber 38 in a manner yet to be described. The striker 14 preferably has a cylindrical body with a tapering closed forward end 56, a rear portion 57 terminating in an open rear end 58, and an external wall 59 surrounding an interior striker chamber 60. The control sleeve 16 is receivable within the interior striker chamber 60 through the open rear end 58 of the striker 14. As used herein, the interior striker chamber 60 is defined as extending from the rear end 58 of the striker 14 and ending a distance from the rear end of the striker into the area inside the striker 14 and forward of the control sleeve 16.

The open rear end 58 of the striker 14 forms a rear impact surface adapted to impact the rearward striker surface 49 of the tail piece assembly 36. The tapering forward end 56 of the striker 14 preferably has a flattened nose 62 forming a forward impact surface for impact with the forward striker surface 50 of the closed front end 43 of the interior operating chamber 38 during reciprocal motion. It should be noted however, that the striker 14 may have any other alternate shape or structure that permits it to be slidingly and sealingly receivable within the interior operating chamber 38 as above.

With continued reference to FIGS. 1 and 2, the rear portion 57 of the striker 14 sealingly engages the inner surface of the interior operating chamber 38 to divide the operating chamber into a forward operating chamber 64 and a rearward operating chamber 65. The rear portion 57 of the striker 14 comprises at least one radial port 66, disposed to permit fluid communication between the operating chambers 64 and 65, the interior striker chamber 60 and the exhaust conduit 47. In the preferred embodiment, a plurality of radial ports 66 are positioned along the outer circumference of the rear portion 57 of the striker 14. The number of radial ports may be increased or decreased so long as fluid communication is permitted between the interior striker chamber 60, the forward operating chamber 64, the rearward operating chamber 65, and the exhaust conduit 47.

Still with reference to FIGS. 1 and 2, in the preferred embodiment, the rear portion 57 of the striker 14 further comprises an annular groove 68. Preferably, the annular groove 68 is located behind the radial ports 66. A wear ring 70 is situated within the annular groove 68 and has a slightly larger diameter than the outer diameter of the striker 14. As a result, instead of the outer surface of the striker 14 making contact with the inner surface of the interior operating chamber 38 of the outer tool housing 12, the wear ring 70, makes contact with the inner surface of the interior chamber to form the forward and rearward operating chambers 64 and 65, respectively, as discussed above.

The wear ring 70 serves a dual purpose. Firstly, the wear ring 70 acts as a seal to help prevent pressurized fluid from leaking from the forward operating chamber 64 to the rearward operating chamber 65. Secondly, the wear ring 70 serves as a wear surface to prevent the striker 14 from wearing out prematurely and can be easily replaced when the boring tool 10 is disassembled. Typically, the wear ring 70 is made of a plastic material or other material softer than the interior surface of the outer tool housing 12 such as, phenolic, UHMW polyethylene, or PET. The wear characteristics of nylon materials are consistent with the needs of this application, but nylon materials are generally unsuitable for this application because of the water absorption characteristics of those materials. It is understood however, that the wear ring 70 may be made of other materials, such as a nitrile O-ring, or may be deleted from the design altogether without affecting the spirit of this invention.

With reference now to FIGS. 1 and 9, to control motion of the striker 14, a directional control member such as the control sleeve 16 is provided. In the preferred embodiment, the control sleeve 16 is slidably receivable with the interior striker chamber 60 of the striker 14 and requires no external mechanical device to bias it in either a forward or rearward position.

With continued reference to FIGS. 1, 2 and 9, preferably, the control sleeve 16 is composed of a flexible material such as PET thermoplastic. However, other materials such as aluminum or steel may be used in the alternative. Preferably, the control sleeve 16 comprises a cylindrical body with an interior sleeve passage 80. The cylindrical body defines a front portion 81, a central portion 82, and a rear portion 83. More preferably, the central portion 82 has a smaller diameter than either the front portion 81 or the rear portion 83. Additionally, the rear portion 83 defines a nodular lobe 84 that has a larger diameter than the front portion 81 to create a larger cross sectional area for reasons that will become obvious later. The nodular lobe 84 of the rear portion 83 has a closed front end 85 and terminates in an open rear end 86 defining a secondary fluid surface. The front portion 81 of the control sleeve terminates in an open front end 87 defining a primary fluid surface. Additionally, the control sleeve 16 defines the continuous sleeve passage 80 between the front end 87 and the rear end 86 of the control sleeve.

Still with reference to FIGS. 1, 2 and 9, in the preferred embodiment, the front portion 81 of the control sleeve 16 is slidably and sealingly supported inside the rear portion 57 of the striker 14 as follows. The front portion 81 of the control sleeve 16 comprises a circumferential groove 90 that contains a wear ring 92, as illustrated in FIG. 2. The wear ring 92 has a diameter slightly larger than the outer diameter of the front portion 84 of the control sleeve 16. As a result, instead of the outer surface of the front portion 84 of the control sleeve 16 making contact with the interior of the striker 14, the wear ring 92 makes contact with the interior of the striker. In this location, the wear ring 92 also serves a dual purpose of first acting as a seal to prevent fluid leaking from between the interior of the striker 14 and the exterior of the control sleeve 16, and additionally, serving as a wear surface to prevent the outer surface of the sleeve 16 from wearing out prematurely. The wear ring 92 can be easily replaced when the boring tool 10 is disassembled. The wear ring 92 preferably is made of a plastic material or other material that is softer than the interior surface of the striker 14. The wear ring 92 may be made of other materials, such as a nitrile O-ring, or may be deleted from the design altogether without affecting the spirit of the invention.

With reference to FIGS. 1 and 9, preferably the rear portion 83 of the control sleeve 16 is supported within a valve chamber 94 (defined in detail later) of the tailpiece assembly 36. As a result, the control sleeve 16 is movable within the hollow interior of the striker 14 and the valve fluid chamber 94 (defined later) between a forward control sleeve position (FIGS. 3 and 4) and a rearward control sleeve position (FIGS. 5 and 6) in a manner yet to be described. When the control sleeve 16 is in the forward position, the boring tool 10 will operate in the forward mode. When the control sleeve 16 is in the rearward position, the boring tool 10 will operate in the reverse mode.

With continued reference to FIGS. 1 and 9, the tail piece assembly 36 preferably comprises a body coupling 110 and a protective tail nut 114. An outer surface of the tail nut 114 forms the rear end 37 of the outer housing 12, and protects the connections of the fluid supply assemblies 18 and 20 respectively. The tail nut 114 houses a primary fluid inlet tube 116 that provides fluid communication between the primary fluid supply 18 and the interior striker chamber 60 as will be discussed in detail later. Preferably, the body coupling 110 is cylindrical and is configured to have a front portion 118 terminating in a front end 120, a body 122, and a rear portion 124 terminating in a rear end 126. It is the front end 120 of the body coupling 110 of the tail piece assembly 36 that forms the rear ward striker surface 49.

Figure 8:
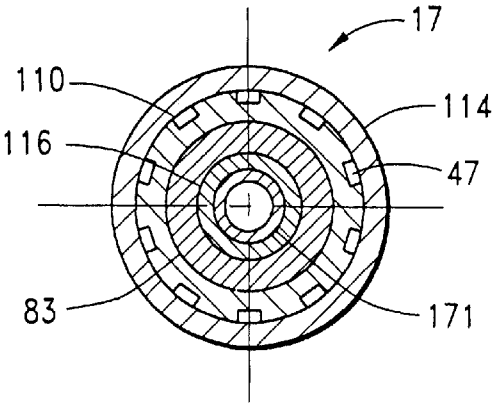
FIG. 8 is a cross-sectional view of the tail piece assembly of FIG. 5 in accordance with the present invention illustrating exhaust conduits.
Figure 8:
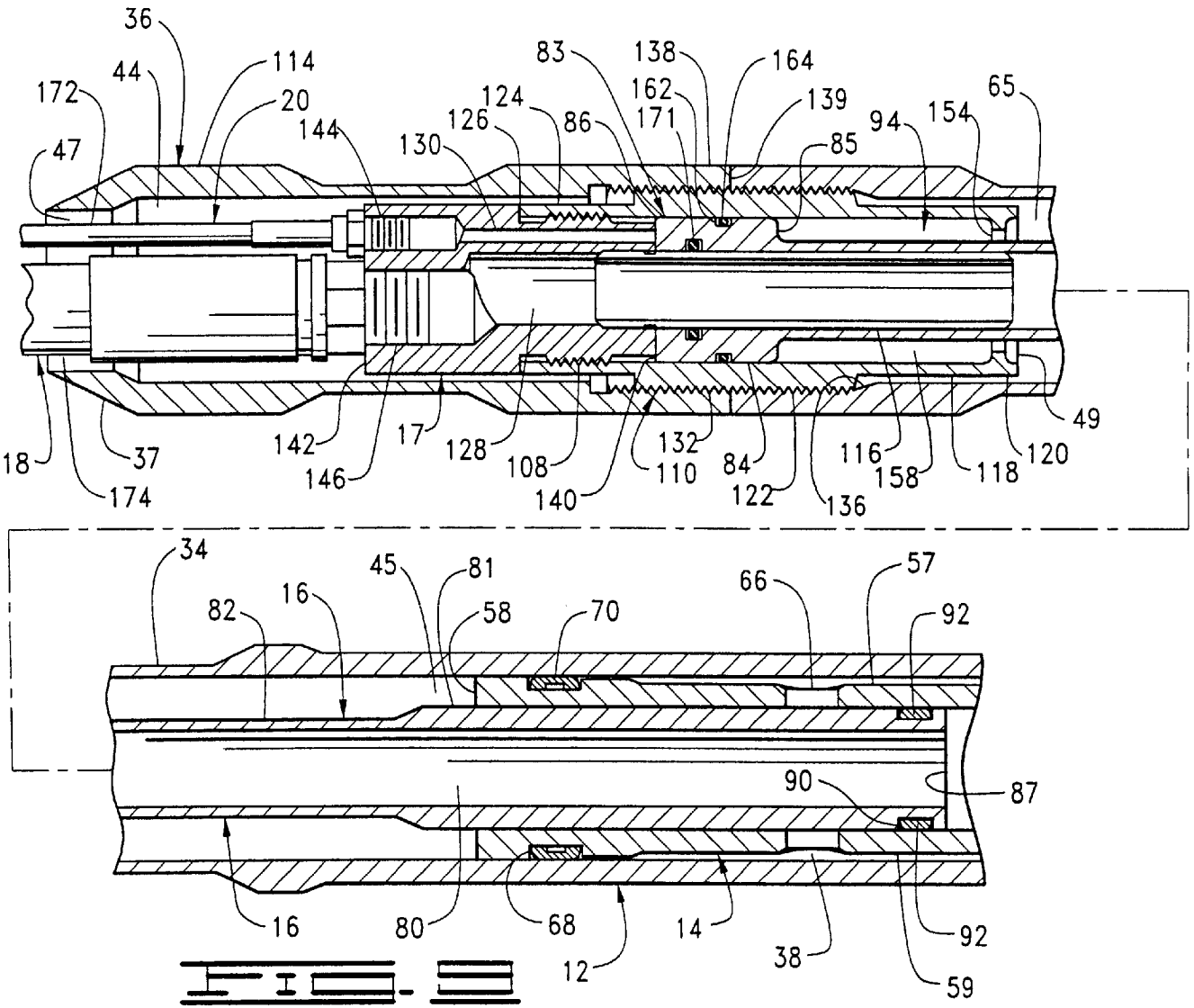

With reference to FIG. 2, an outer circumference of the body 111 of the body coupling 110 comprises external threads 132. Slots 134 are milled along the longitudinal axis of the body 111 of the body coupling 110 to permit the passage of fluid. This arrangement serves a dual purpose. Firstly, the external threads 132 provide an attachment mechanism whereby the protective tail nut 114 is threaded onto the rear portion 124 of the body coupling 110 and the front portion 118 of the body coupling is threaded onto the internal threads of the body 34 of the external outer housing 12. Secondly, the milled slots 134 through the external threads 132 form part of the exhaust conduit 47 (FIG. 2) that allows for the passage of air from the rear operating chamber 65 to the exterior of the tool. This arrangement is further shown in the cross-section illustration of FIG. 8.

With reference now to FIGS. 1, 2 and 9, the body coupling 110 bottoms out on a shoulder 136 inside the outer housing 12 before all the external thread is used up. The internal thread on the protective tail nut 114 is threaded onto the remaining exposed thread of the body coupling 110. Once a front shoulder 138 (FIG. 2) of the protective tail nut 114 contacts a rear shoulder 139 (FIG. 2) of the outer housing 12 of the boring tool 10, as the protective tail nut 114 is tightened further, the threaded connections between the outer housing 12 and the body coupling 110 and between the body coupling 110 and the protective tail nut 114 become preloaded to lock all three components together.

With continued reference to FIGS. 1 and 9 preferably, the manifold nut 17 is located substantially within the interior of the protective tail nut 114 near the rear end 44 of the interior chamber 38 and has a first end 140 and a second end 142. An internal thread of the first end 140 of the manifold nut 17 is threaded (not shown) to the primary fluid inlet tube 116 and an external thread of the first end of the manifold nut 17 is threaded to an internal thread of the rear portion 124 of the body coupling 110. Additionally, the second end 140 of the manifold nut 17 preferably, has two internally threaded ports 144 and 146, respectively. The internal threads of the ports 144 and 146 at the second end 142 of the manifold nut 17 are threaded to the primary fluid supply 18 and secondary fluid supply 20 of the compressed fluid supply system 51 for both the striker 14 and the sleeve 16, respectively. That is, the manifold nut 17, forms a primary fluid conduit 128 for the fluid supply for movement of the striker 14 and a secondary fluid conduit 130 for the fluid supply for movement of the control sleeve 16.

Still with reference to FIGS. 1 and 9, preferably, prior to the attachment of the manifold nut 17 to the internal thread of the rear end portion 124 of the body coupling 110, the control sleeve 16 is inserted into the front cylindrical portion 118 of the body coupling 110 from the rear end 126 of the body coupling. The control sleeve 16 is then slidingly movable toward the front end 120 of the body coupling 110. The front end 120 of the body coupling 110 comprises an abutting shoulder around the outer inner rim such as a stop 154 that prevents the front end 85 of the larger diameter nodular rear portion 84 of the control sleeve 16 from exiting from the front end 120 of the body coupling 110. The stop 154 may be made as an integral part of the body coupling 110. However, any other mechanism such as a snap ring, radially placed pin, or threaded ring may be used either integrally as part of the body coupling 110 or the interior operating chamber 38 of the outer housing 12, that would act as the limiting boundary for the forward progression of the control sleeve 16.

Still with continued reference to FIGS. 1 and 9, preferably, an inner wall of the body coupling 110 between the front end 120 of the body coupling and the rear portion 124 of the body coupling 110 defines the valve chamber 94. The valve chamber 94 houses the nodular lobe 84 of the rear portion 83 of the control sleeve 16 between the front end 120 of the body coupling 110 and the first end 140 of the manifold nut 17 after the manifold nut is threadably connected to the rear portion 83 of the body coupling.

One skilled in the art will appreciate that a loose sliding fit exists between the exterior of the nodular lobe 84 at the rear portion 83 of the control sleeve 16 and the inner wall of the valve chamber 94. This fit is typically the equivalent of an ASME RC 9 loose running fit, or looser. The loose fit between the exterior of the nodular rear portion 83 of the sleeve 16 and the interior of the body coupling 110 gives a small amount of angular deflection capability of the sleeve within the body coupling, somewhat like a ball and socket joint. The angular deflection capability coupled with the flexible material in the control sleeve 16 itself gives the tool the ability to accommodate slight tool body deflections without stalling.

Additionally, as illustrated in FIG. 9, the nodular lobe 84 of the rear portion 83 of the control sleeve 16 sealingly engages the inner wall of the valve chamber 94 to divide the valve chamber into a front valve 158 chamber and a rear valve chamber 160 as follows. Preferably, the nodular lobe 84 of the rear portion 83 of the control sleeve 16 comprises an annular groove 162. A wear-ring 164 is situated within the annular groove 162 and has a slightly larger diameter than the outer diameter of the nodular lobe 84 of the control sleeve 16. As a result, instead of the outer surface of the nodular lobe 84 of the rear portion 83 of the control sleeve 16 making contact with the inner wall of the valve chamber 94, the wear-ring 164 makes contact with the inner wall of the valve chamber to form the front and rear valve chambers 158 and 160, respectively, as discussed above.

The wear-ring 164 serves a dual purpose. Firstly, the wear-ring 164 acts as a seal to help prevent pressurized fluid from leaking from the rear valve chamber 160 to the front valve chamber 158. Secondly, the wear-ring 164 serves as a wear surface to prevent the control sleeve 16 from wearing out prematurely and can be easily replaced with the boring tool 10 is disassembled. Typically, the wear-ring 164 is made of the same material as the wear-ring 70.

Thus, the front valve chamber 158 is formed between the front end 120 of the body coupling 110 and the wear-ring 164. The rear valve chamber 160 is formed between the wear-ring 164 and the first end 118 of the manifold nut 17. The rear valve chamber 160 may be pressurized or depressurized through a supply of compressed fluid as will be discussed herein. It is the pressure in this rear valve chamber 160, or the lack thereof, that determines the position of the control sleeve 16 and, thus, whether the boring tool 10 will operate in a forward mode or a reverse mode.

Referring again to FIG. 1, preferably, the compressed fluid supply to the striker 14 and the control sleeve 16 is from a common source such as the compressed fluid supply system 51. However, the fluid supply is provided to the interior striker chamber 60 and the rear valve fluid chamber 144 by way of separate fluid supply assemblies, such as the primary fluid supply assembly 18 and the secondary fluid supply assembly 20 respectively.

In the preferred embodiment illustrated in FIG. 1, the primary fluid supply assembly 18 comprises a primary fluid supply tube 170 that enters the outer housing 12 through a primary inlet in the tail piece assembly 36 and is connectable to the primary fluid inlet tube 116 through the primary fluid conduit 128 of the manifold nut 17. The primary fluid inlet tube 116 extends from the primary fluid conduit 128 a distance into the hollow interior passage of the control sleeve 16 that is the interior sleeve passage 80. The nodular lobe 84 at the rear portion 83 of the control sleeve 16 is slideably and sealingly supported on the primary fluid inlet tube 116 at least partially inside the valve chamber 94 to form a through channel for the passage of fluid from the primary fluid supply tube 170 to the interior of the striker 14. Additionally, there is no annular passage between the control sleeve 16 and the primary fluid inlet tube 116. Instead, both these members are close fitting and any remaining gap between them is sealed with an O-ring 171 to form a pressurized chamber within the interior of the body coupling 110.

As a result, in response to the supply of primary operating fluid, the interior striker chamber 60 will become pressurized and cause the striker 14 to reciprocate between the forward position (FIGS. 3 and 4) in which the radial ports 66 are open between the interior striker chamber 60 and the forward operating chamber 64, and the rearward position (FIGS. 5 and 6) in which the radial ports 66 are open between the forward operating chamber and the rearward operating chamber 65, thereby allowing the pressurized fluid in the forward operating chamber 64 to escape out the back of the tool through the exhaust conduit 47.

In the preferred embodiment, as illustrated in FIG. 1, the secondary fluid supply assembly 20 comprises a secondary fluid supply tube 172 that enters the outer housing 12 through a secondary inlet in the tail piece assembly 36 and is connectable to the rear valve fluid chamber 144 through the secondary fluid conduit 130 of the manifold nut 17. That is, the manifold nut 17 provides the passage or channel for the fluid through the nut from the secondary fluid supply tube 172 to the rear valve fluid chamber 160. Preferably, the secondary fluid supply tube 172 is smaller in diameter than the primary supply tube 170. Additionally, the tubes 170 and 172 are preferably non-concentric with each other.

Preferably, both fluid supply tubes 170 and 172 are connected to separate hoses supplying compressed fluid at the same pressure. Also preferably, the primary supply tube 170 and the secondary supply tube 172 are connected to a primary fluid supply hose 174 and secondary fluid supply hose 176 respectively, through quick connect fittings 178 and 180 respectively. The quick connect fittings 178 and 180 simplify the connection of these lines to their respective fluid supply hoses coming from the compressor. However, it is understood that more traditional twist type connectors, or any other type of connectors, may be substituted on the hoses without departing from the spirit of the invention.

With continued reference to FIG. 1, the secondary fluid supply assembly 20 comprises a control valve 190 mounted at a convenient position for control, preferably at an operator's station, for supplying pressurized fluid to or exhausting pressurized fluid from the valve fluid chamber 142. The control valve 190 contains ports (not shown) such that when the control valve is shut off, the pressurized fluid is exhausted from the rear valve fluid chamber 144. When the control valve 190 is opened, pressurized fluid passes into the rear valve fluid chamber 144. In the preferred embodiment, the pressurized fluid used to move the sleeve 16 and the striker 14 is air. However, it is understood that alternate fluids such as water, hydraulic oil, or compressed carbon dioxide could be used without departing from the spirit of the invention.

The control sleeve 16 preferably is movable between a forward position (FIGS. 3 and 4), wherein the front end 85 of the nodular lobe 84 of the rear portion 83 of the control sleeve contacts the front end 120 of the body coupling 110, and a rearward position (FIGS. 4 and 5) wherein the secondary fluid surface of the rear end 86 of the nodular rear portion 83 contacts the first end 118 of the manifold nut 17. The movement towards the forward position (FIGS. 3 and 4) is in response to pressurization of the rear valve chamber 160 and movement towards the rearward position (FIGS. 5 and 6) is in response to depressurization of the rear valve chamber 160.

One skilled in the art will appreciate that the control sleeve 16 is moved towards the forward position (FIGS. 3 and 4) and held in that position solely by positive pressure in the rear valve chamber 160. That is, when the rear valve chamber 160 is pressurized, the force of the primary pressurized fluid acting on the front portion 84 of the control sleeve 16 that is, on the primary fluid surface is unable to cause the control sleeve to move to the, rearward position. When the rear valve chamber 160 is depressurized, now the force of the primary pressurized fluid acting on the front portion 84 of the control sleeve 16 is able to cause the control sleeve to move to the rearward position 11.

Figure 5:
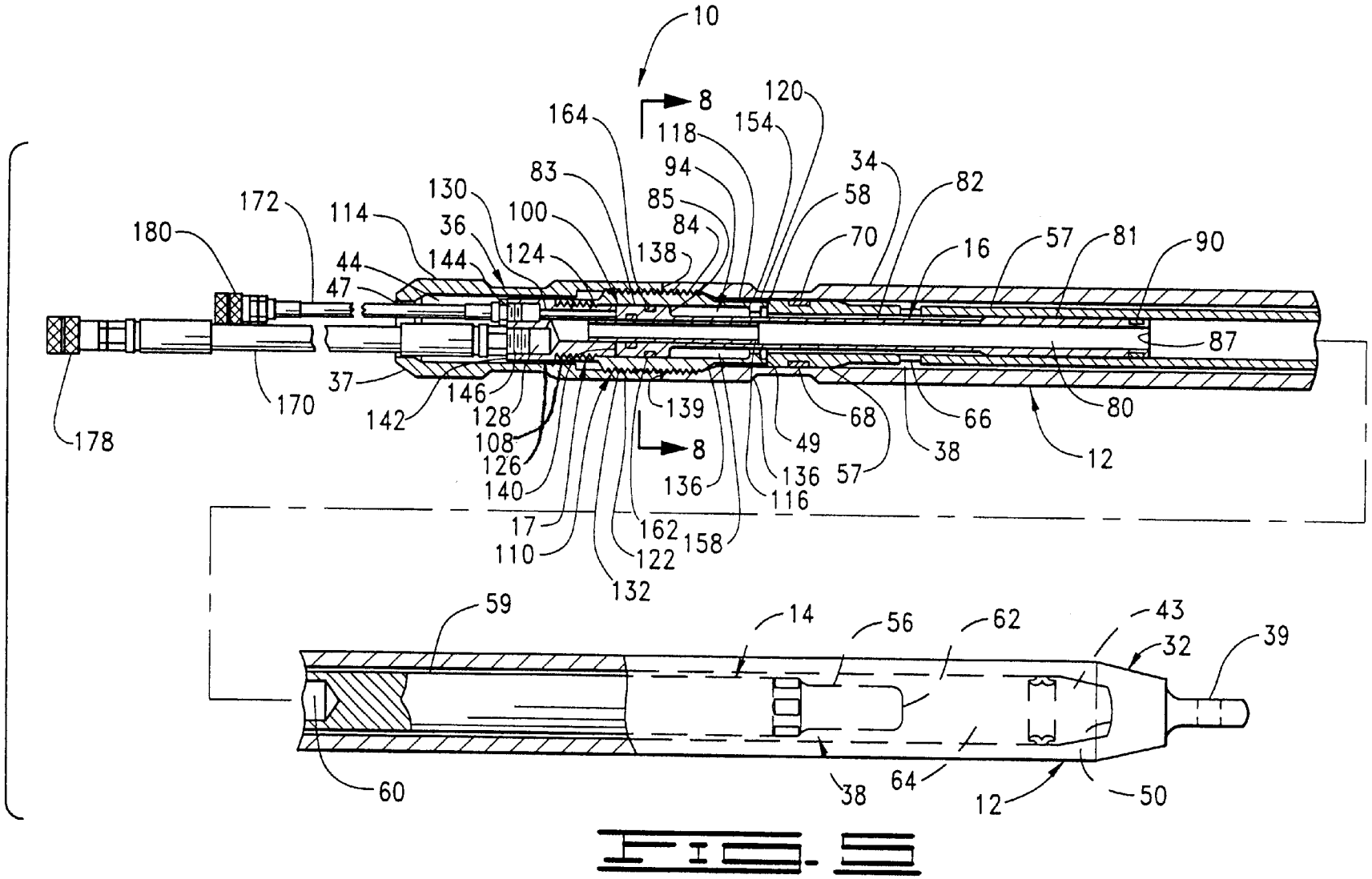
FIG. 5 is a longitudinal party cross-sectional view of the tool assembly of FIG. 1 constructed in accordance with the present invention illustrating the boring tool in the reverse mode with the striker at the rearward striker surface.
Figure 3:
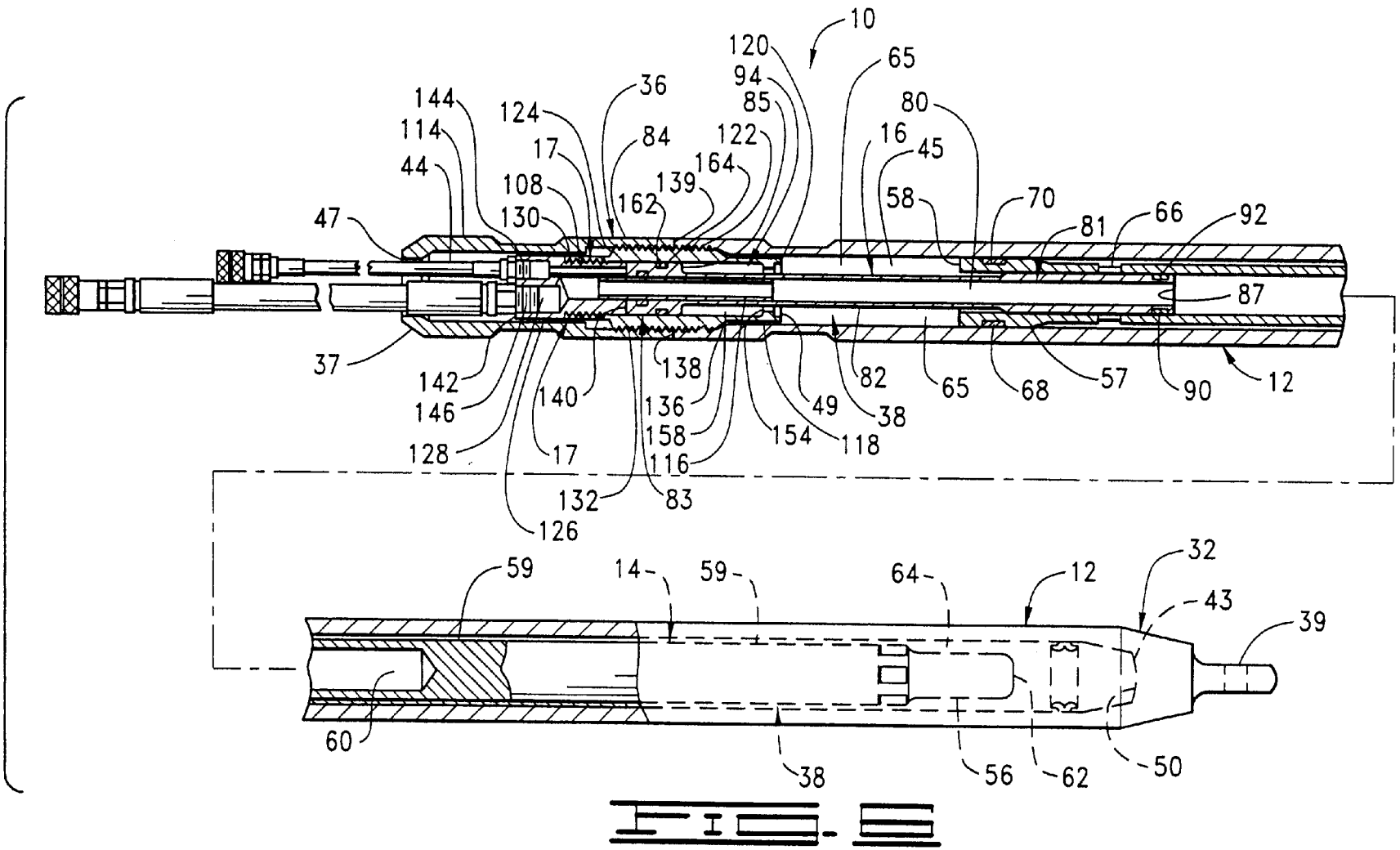

The determining factor on whether the striker 14 will impact the front or the rear of the boring tool 10 as it cycles back and forth is the position of the control sleeve 16. That is, when the control sleeve 16 is in the rearward position as shown in FIG. 5, the striker 14 will impact the rearward striker surface 49 at the front end 120 of the body coupling 110 and the progression of the tool in the hole will be in the reverse direction. When the control sleeve 16 is in the forward position as shown in FIG. 3, the striker 14 will impact on the forward striker surface 50 at the front of the boring tool 10 and drive it forward in the hole.

Figure 3:
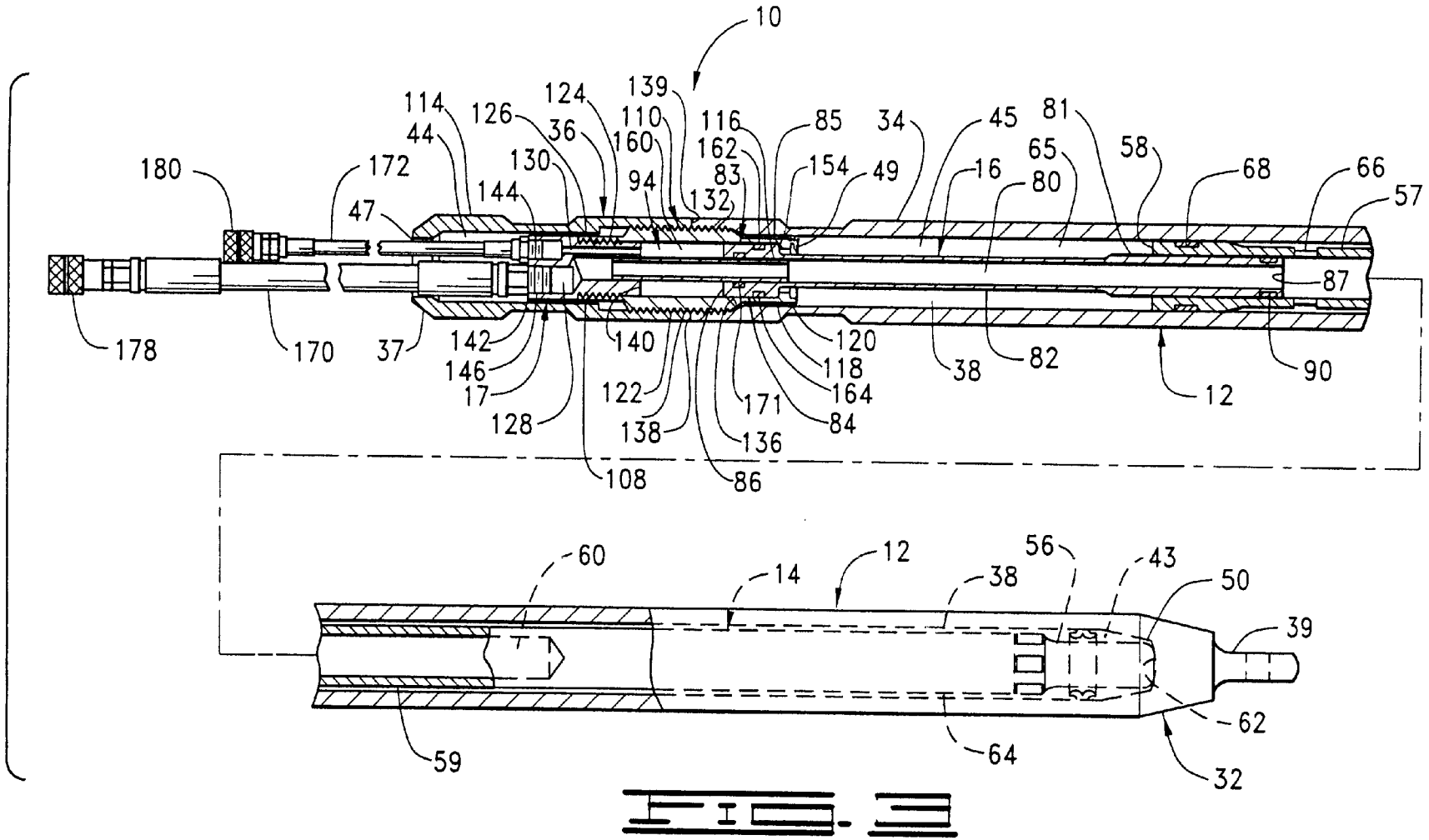
FIG. 3 is a longitudinal partly cross-sectional view of the tool assembly of FIG. 1 constructed in accordance with the present invention illustrating the boring tool in the forward mode with the striker at the forward striker surface.

Turning now to FIGS. 3–6, the operation of the detailed sequence of events at each mode of operation of the tool will be described for the preferred embodiment. As illustrated in FIG. 3, to begin the boring operation, the boring tool 10 is operated in the forward mode. For this, the control valve 190 is opened to permit the rear valve fluid chamber 144 to become pressurized. As the rear valve fluid chamber 144 is pressurized, the pressurized fluid acting on the larger secondary fluid cross sectional area of the nodular lobe 84 of the rear portion 83 of the control sleeve 16 will cause the control sleeve to move forward into the forward sleeve position (FIG. 3). Positive pressure in the rear valve fluid chamber 144 will hold the non-mechanically biased control sleeve 16 in the forward position for so long as sufficient positive pressure on the secondary fluid surface is maintained.

Simultaneously, the drive fluid for the boring tool 10 is routed through the manifold nut 17 into the primary fluid inlet tube 116. The drive fluid passes through the primary fluid inlet tube 116 and through the interior of the control sleeve 16 into the interior striker chamber 60. The pressure of the fluid inside the striker 14 will cause the striker to move forward within the interior operating chamber 38 of the outer tool housing 12. As the striker 14, progresses forward in the interior operating chamber 38 of the outer tool housing 12, eventually the radial ports 66 in the rear end wall of the striker 14 will pass by the front portion 81 of the control sleeve 16 as seen in FIG. 3.

At this time, the compressed fluid in the cavity inside the striker 14, that is, in the interior striker chamber 60 will be free to flow into the annular space between the outside of the striker and the inside of the tool body, that is, into the forward operating chamber 64. Once the forward operating chamber 64 fills with fluid, pressure develops in this region which begins to slow the forward progress of the striker 14. When the tool 10 is running in the forward mode, the striker 14 will proceed forward until the forward end 56 of the striker impacts on the forward striker surface 50 of the interior operating chamber 38 of the outer tool housing 12.

At this point, since the striker 14 will tend to rebound off of the forward striker surface 50 and since the cross-sectional area on the outside of the striker 14 is greater than on the inside of the striker, the striker will begin to move towards the rear of the boring tool 10. This rearward progress of the striker 14 will continue largely unabated until the radial ports 66 in the striker 14 pass by the rear edge of the front cylindrical portion 81 of the control sleeve 16. Once the radial ports 66 in the striker reach this point, the pressurized fluid in the cavity between the outside of the striker 14 and inside of the outer tool housing 12, that is in the forward operating chamber 64, will flow through the radial ports 66 into the rear operating chamber 65 and will be vented out of the boring tool 10 through the exhaust conduit 47.

Figure 4:
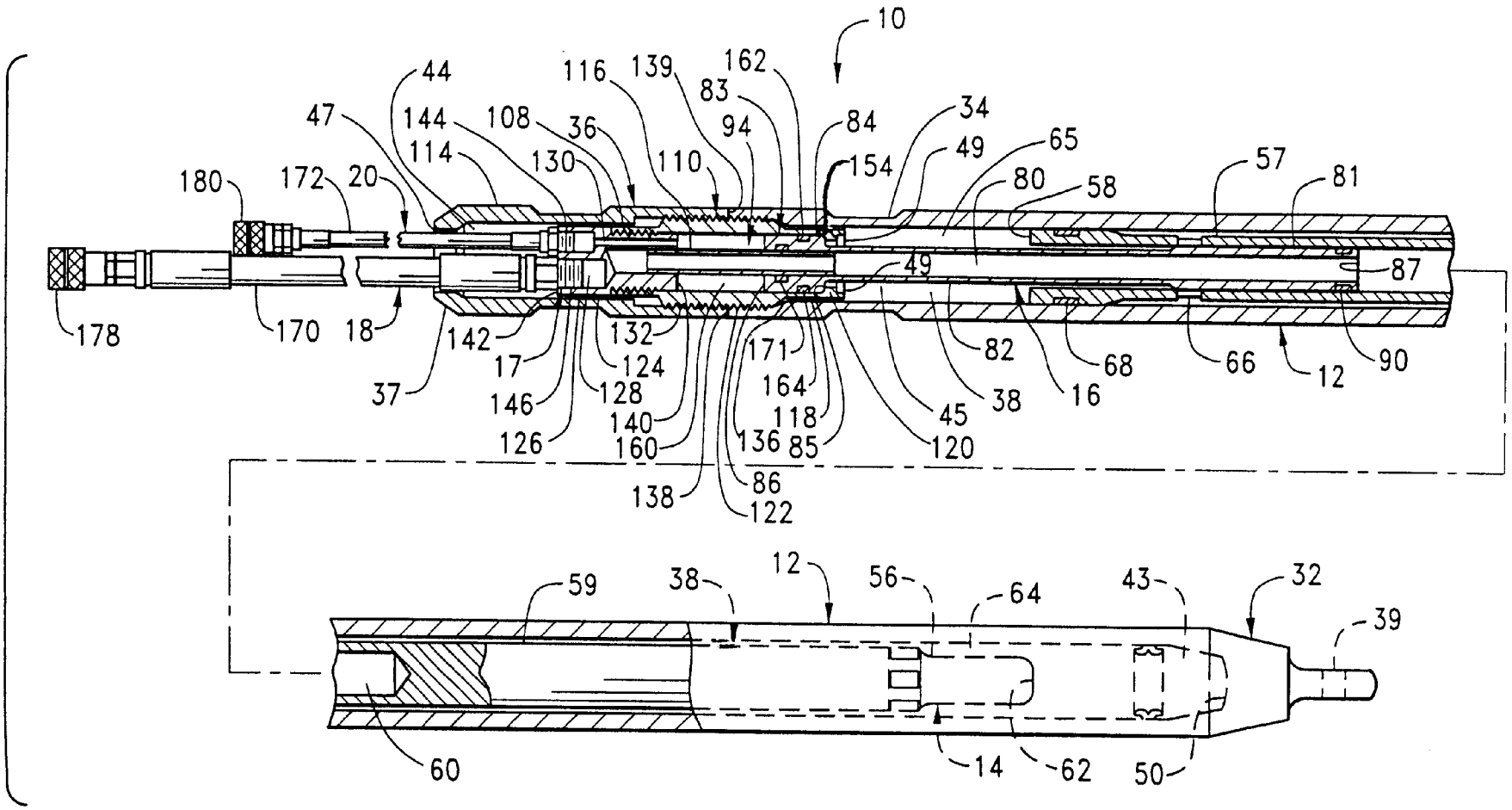
FIG. 4 is a longitudinal partly cross-sectional view of the tool assembly of FIG. 1 constructed in accordance with the present invention illustrating the boring tool in the forward mode with the striker away from the forward striker surface.

When the pressurized fluid in front of the striker 14, that is, in the forward operating chamber 64 is vented to atmosphere, then the pressure of the air in the interior striker chamber 60 will cause the striker 14 to begin to slow its rearward movement. As a result, the striker 14 will stop its rearward progression and begin to move forward again without impacting the front end of the body coupling 110, that is, the rearward striker surface 49, as illustrated in FIG. 4.

To begin operation in the reverse mode, the control valve 190 is shut off. This simultaneously terminates the supply of pressurized fluid to the rear valve chamber 160 and enables the exhaust of pressurized fluid present in the rear valve fluid chamber 160 to the atmosphere through ports (not shown) in the control valve 190. As the fluid is exhausted from the rear valve fluid chamber 144, now the pressure exerted on the primary fluid surface of the front end 87 of the control sleeve 16 by the pressurized fluid in the interior striker chamber 60 will be sufficient to cause the control sleeve 16 to slide rearward, thereby moving the control sleeve 16 to the rearward position (FIG. 5).

The primary fluid supply assembly 18 continually supplies pressurized fluid to the interior striker chamber 60. With the control sleeve 16 now in the position depicted in FIG. 5, the forward travel of the striker 14 is shortened, and the rearward travel is lengthened. During forward movement of the striker 14, as illustrated in FIG. 6, the radial ports 66 in the striker 14 connect the interior striker chamber 60 with the forward operating chamber 64 sooner than when the tool is operating in the forward mode. The striker 14 thus begins traveling rearward before impacting on the forward striker surface 50.

Thus, when the boring tool 10 is operating in the reverse mode, fluid pressure in the cavity between the front of the boring tool 10 and the striker 14, that is, the forward operating chamber 64, will bring the striker 14 to a stop before it impacts the forward striker surface 50 (FIG. 6). At this point, since the cross-sectional area on the outside of the rear end 58 of the striker 14 is greater than that on the inside of the striker 14, that is, in the interior striker chamber 60, the striker will begin to move toward the rear of the boring tool 10. This rearward progression of the striker 14, will continue largely unabated until the radial ports 66 in the striker 14 pass by the rear edge of the front cylindrical portion 81 of the control sleeve 16. Once the radial ports 66 in the striker 14 reach this point, the pressurized fluid in the cavity between the outside of the striker 14 and the inside of the outer tool housing 12, that is, in the rear operating chamber 65 will be vented to atmospheric pressure. From this point on, the fluid is free to flow out of the rear operating chamber 65 through the exhaust conduit 47, that is the milled slots 134 on the outer circumference of the body coupling 110. When the pressurized fluid in the front of the striker 14, that is, in the forward operating chamber 64, is vented to the atmosphere, then the pressure of the fluid inside of the striker 14, that is, in the interior striker chamber 60, will cause the striker to begin to slow its rearward movement. However, the striker 14 will continue its rearward motion until it impacts the front end of the body coupling 110, that is the rearward striker surface 49. This impact is what causes the outer tool housing 12 to be driven backwards within the formed hole.

During the rearward movement of the striker 14, it may be noted that the radial ports 66 in the striker 14 connect the forward operating chamber 64 with the atmosphere through the exhaust conduits 47 much later (i.e., the striker must be closer to the tailpiece than when this occurs in the forward mode). As shown in FIG. 5, the radial ports 66 in the striker 14 do not connect the forward operating chamber 64 with the axial exhaust conduits 47 until the rear end 58 of the striker 14 approaches the rearward striker surface 49 of the interior operating chamber 38. Impact against the rear of the boring tool 10 is thereby achieved. As with the forward operation, the striker 14 will continue to reciprocate against the rearward striker surface 49 as long as the primary fluid supply assembly 18 continues to supply pressurized fluid to the interior striker chamber 60.

To switch back to the forward mode, the control valve 190 is once again opened. As pressurized fluid begins to pass into the rear valve fluid chamber 144, the force acting on the secondary fluid surface area of the nodular lobe 84 of the rear portion 83 of the control sleeve 16 will become greater than the force of the primary fluid on the primary fluid surface of the front portion of the control sleeve and will cause the control sleeve 16 to slide forward to the position shown in FIG. 3, abutting the stop 154 of the body coupling 110. The stop 154 prevents the control sleeve 16 from sliding any further forward. With the control sleeve 16 in the position shown in FIG. 3, the striker 14 once again impacts against the forward striker surface 50 of the interior operating chamber 38 during forward axial movement. Thus, as a result of the larger cross-sectional area of the nodular lobe 84 of the rear portion 83 of the control sleeve 16 as compared with the cross-sectional area of the front portion 81 of the control sleeve 16, the force from the secondary fluid acting on the secondary fluid surface is sufficient to overcome the force of the primary fluid acting on the primary fluid surface to maintain the control sleeve in the forward position shown in FIG. 3.

It will be understood that the above description is of a preferred exemplary embodiment of the invention and is meant to be illustrative, not limitative. Modifications may be made in the structural features of the invention without departing from the scope of the invention as expressed in the appended claims.

What is claimed:

1. An impact-operated, ground-penetrating drilling assembly comprising:

a boring tool;

a primary fluid supply system adapted to supply pressurized fluid to power movement of the boring tool; and a secondary fluid supply system adapted to supply pressurized fluid to control movement of the boring tool between a forward operating mode and a reverse operating mode;

wherein the boring tool comprises:

a housing having a front end, a rear end, and body defining an interior operating chamber with an inner surface, an exhaust conduit providing communication between the operating chamber and the outside of the tool, a forward striker surface, and a rearward striker surface;

a striker reciprocally supported within the operating chamber of the housing between the forward and rearward striker surfaces, the striker having a forward end, a rear portion terminating in a rear end, and a striker body defining an interior striker chamber, wherein the rear portion of the striker sealingly engages the inner surface of the operating chamber to divide the operating chamber into a forward operating chamber and a rearward operating chamber, the rearward operating chamber continuous with the exhaust conduit, wherein the striker body has at least one striker port to provide fluid communication between the forward operating chamber and the interior striker chamber;

a manifold near the rear end of the housing and comprising a primary conduit connectable to the primary fluid supply system and a secondary conduit connectable to the secondary fluid supply system;

a primary fluid inlet tube extending from the primary conduit of the manifold;

a valve chamber configured to have a front valve chamber and a rear valve chamber, the rear valve chamber being in fluid communication with the secondary conduit in the manifold;

a control sleeve having a rear portion, a front portion, and an interior sleeve chamber defining a passage between the rear portion and the front portion, wherein the front portion of the control sleeve is slidably and sealingly supported inside the rear portion of the striker, wherein the rear portion of the control sleeve is slidably and sealingly supported on the primary fluid inlet tube at least partially inside the valve chamber, whereby the sleeve provides continuous fluid communication between the primary fluid inlet tube and the striker chamber, so that in response to a supply of primary fluid the striker reciprocates between a forward position in which the striker port is open between the interior striker chamber and the forward operating chamber and a rearward position in which the striker port is open between the forward operating chamber and the rearward operating chamber and exhaust conduit; and wherein the rear portion of the sleeve includes a nodular lobe inside the valve chamber that sealingly engages an inner wall of the valve chamber and divides the valve chamber into the front valve chamber and the rear valve chamber, the nodular lobe being movable between a forward position in response to pressurization of the rear valve chamber and a rearward position in response to depressurization of the rear valve chamber, so that the forward portion of the sleeve moves between a forward position in which the striker hits the forward striker surface as it reciprocates and a rearward position in which the striker hits the rearward striker surface as it reciprocates.

2. The assembly of claim 1 wherein the secondary fluid supply system comprises:

a control valve adapted to control flow of pressurized fluid into the rear valve chamber, the control valve being adapted to operate in an open position and a closed position; and wherein when the control valve is in the open position, the rear valve chamber is maintained in a pressurized state to operate the boring tool in a forward mode.

3. The assembly of claim 2 wherein the control valve comprises at least one exhaust port adapted to permit pressurized fluid to escape from the rear valve chamber when the control valve is in the closed position.

4. The assembly of claim 1 wherein the primary and the secondary fluid supply systems comprise a common compressed fluid sources.

5. The assembly of claim 1 wherein the primary fluid supply system comprises:

a primary fluid supply tube adapted to fluidly connect to the primary fluid inlet tube; and wherein the secondary fluid supply system comprises a secondary fluid supply tube adapted to fluidly connect to the rear valve chamber.

6. The assembly of claim 5 wherein the primary fluid supply tube and the secondary fluid supply tube are arranged non-concentrically with respect to each other.

7. The assembly of claim 1 wherein the largest cross sectional area of the rear portion of the control sleeve taken perpendicular to the longitudinal axis of the control sleeve is greater than the largest cross sectional area of the front portion of the control sleeve taken perpendicular to the longitudinal axis of the control sleeve.

8. The assembly of claim 1 wherein the body of the housing comprises at least two separate components joined by friction welding.

9. The assembly of claim 1 wherein the tool is operable in the forward operating mode so long as the control sleeve is maintained in the forward position by non-mechanically biasing the rear valve chamber.

10. The assembly of claim 1 wherein the housing further comprises a tailpiece assembly, and wherein the tailpiece assembly comprises:

a body coupling having a front end, a rear end and an inner wall; and a tail nut;

wherein the front end of the body coupling is contained within the body of the housing to form the rearward striker surface, the rear end of the body coupling is contained within the tail nut, and the inner wall of the body coupling defines the valve chamber between the front end and the rear end of the body coupling, such that the front end of the body coupling defines the forward position of the control sleeve.

11. The assembly of claim 10 wherein the valve chamber defines the rear valve chamber between the rear portion of the control sleeve and the rear end of the body coupling.

12. The assembly of claim 10 wherein the manifold comprises a manifold nut and wherein the inner wall of the rear end of the body coupling comprises internal threads to threadingly engage external threads on an outer wall of the manifold nut, such that a first end of the manifold nut is housed within the inner wall of the body coupling, the manifold nut being adapted to prevent rearward motion of the control sleeve beyond the reverse position of the control sleeve.

13. The assembly of claim 10 wherein the body coupling further comprises an outer wall with external threads adapted to threadingly engage internal threads of the rear end of the housing.

14. The assembly of claim 13 wherein the outer wall of the body coupling further comprises a plurality of slots milled along a longitudinal axis of the body coupling forming the exhaust conduit to permit passage of fluid.

15. The assembly of claim 1 wherein the slidable engagement between the control sleeve and the valve chamber is adapted to permit angular deflection of the control sleeve within the valve chamber.

16. A method of using an impact-operated, ground-penetrating tool for a boring operation, the tool comprising an interior striker chamber and a valve chamber, the valve chamber being configured to have a front valve chamber and a rear valve chamber, and wherein, the method comprises:

operating the tool in a forward operating mode by substantially simultaneously pressurizing the rear valve chamber and the interior striker chamber with fluid;

maintaining the tool in the forward operating mode solely by pressurization of the rear valve chamber; and operating the tool in a reverse operating mode by substantially simultaneously pressurizing the interior striker chamber and depressurizing the rear valve chamber.

17. The method of claim 16 wherein the tool further comprises a control sleeve and wherein the method further comprises moving the control sleeve between a forward position when the rear valve chamber is pressurized and a rearward position when the rear valve chamber is depressurized.

18. The method of claim 17 further comprising repeating the above steps a desired number of times within a bore until the boring operation is completed.

19. The method of claim 17 wherein the tool further comprises a housing defining a forward operating chamber and wherein the step of operating the tool in the forward mode comprises:

alternately pressurizing the interior striker chamber to a pressure greater than a pressure in the forward operating chamber while the rear valve chamber is pressurized; and alternately depressurizing the interior striker chamber to a pressure equal to the pressure in the forward operating chamber while the rear valve chamber is pressurized.

20. The method of claim 17 wherein the step of maintaining the tool in the forward mode further comprises maintaining the control sleeve in the forward position.

21. The method of claim 17 wherein the tool further comprises a housing defining a forward operating chamber and wherein the step of operating the tool in the reverse mode comprises:

alternately pressurizing the interior striker chamber to a pressure greater than a pressure in the forward operating chamber when the rear valve chamber is depressurized; and alternately depressurizing the interior striker chamber to a pressure equal to the pressure in the forward operating chamber when the rear valve chamber is depressurized.

22. The method of claim 17 wherein the step of maintaining the tool in the reverse mode further comprises maintaining the control sleeve in the rearward sleeve position.

23. The method of claim 16 further comprises pressurizing the interior striker chamber and the rear valve chamber from a common source.

24. The method of claim 23 wherein the step of pressurizing the interior striker chamber and the rear valve chamber from the common source comprises supplying compressed fluid at the same pressure.

25. An impact-operated, ground-penetrating tool for use with a primary supply of pressurized fluid and a secondary supply of pressurized fluid, the tool comprising:

a housing having a front end, a rear portion, and an interior operating chamber with a forward striker surface and a rearward striker surface, wherein the rear portion of the housing includes a primary inlet adapted to receive the primary supply of pressurized fluid and a secondary inlet adapted to receive the secondary supply of pressurized fluid;

a striker slidably and sealingly supported inside the operating chamber for reciprocal movement therein between the forward striker surface and the rearward striker surface, the striker having a forward impact surface adapted to impact the forward striker surface whereby the tool is operable in the forward mode, a rear impact surface adapted to impact the rearward striker surface whereby the tool is operable in the rearward mode, wherein the striker further comprises a rear end and an interior striker chamber opening at the rear end and ending a distance from the rear end;

a valve chamber in the rear portion of the housing configured to have a first end, a second end, and comprising a front valve chamber toward the first end and a rear valve chamber toward the second end, the rear valve chamber being in fluid communication with secondary inlet;

a control sleeve having a front portion terminating in an open front end defining a primary fluid surface, a rear portion terminating in an open rear end defining a secondary fluid surface, and a sleeve passage therethrough. continuous with the front end and the rear end thereof, wherein the rear portion of the control sleeve is sealingly and slidably supported inside the valve chamber such that the rear portion of the control sleeve engages an inner wall of the valve chamber and divides the valve chamber into the front valve chamber and the rear valve chamber, for movement therein in response to pressure, in the rear valve chamber from the secondary supply of pressurized fluid, the control sleeve being movable between a forward position in which the rear portion of the control sleeve approaches the first end of the valve chamber and a rearward position in which the rear portion of the control sleeve approaches the second end of the valve chamber, and wherein the sleeve passage is in constant fluid communication with the primary inlet;

wherein the rear portion of the striker is slidingly and sealingly supported on the: front portion of the control sleeve so that the interior striker chamber is in fluid communication with the sleeve passage whereby the striker is movable in response to pressure from the primary supply of pressurized fluid;

wherein the rear portion of the striker comprises a, fluid port to provide fluid communication between the interior striker chamber and the interior operating chamber of the housing, the port being positioned so that when the control sleeve is in forward position the striker operates in the forward mode and so that when the control sleeve is in the rearward position the striker operates in the rearward mode;

wherein the primary fluid surface of the control sleeve is adapted to receive pressure from the primary supply of pressurized fluid in the striker chamber to move the control sleeve toward the rearward position;

wherein the secondary fluid surface of the control sleeve is adapted to receive pressure from the secondary supply of pressurized fluid in the valve chamber to move the control sleeve toward the forward position; and wherein a cross-sectional area of the secondary fluid surface taken perpendicular to the longitudinal axis of the control sleeve is greater than a cross-sectional area of the primary fluid surface taken perpendicular to the longitudinal axis of the control sleeve so that pressure from the secondary fluid acting on the secondary fluid surface is sufficient to overcome the pressure of the primary fluid on the primary fluid surface and maintain the control sleeve in the forward position.

26. The tool of claim 25 wherein the tool is operable in the forward operating mode so long as the control sleeve is maintained in the forward position by non-mechanically biasing the rear valve chamber.

27. The tool of claim 25 wherein the housing further comprises a tailpiece assembly, and wherein the tailpiece assembly comprises:

a body coupling having a front end, a rear end and an inner wall; and a tail nut;

wherein the front end of the body coupling is contained within the body of the housing to form the rearward striker surface, the rear end of the body coupling is contained within the tail nut, and the inner wall of the body coupling defines the valve chamber between the front end and the rear end of the body coupling, such that the front end of the body coupling defines the forward position of the control sleeve.

28. The tool of claim 27 wherein the valve chamber defines the rear valve chamber between the rear portion of the control sleeve and the rear end of the body coupling.

29. The tool of claim 27 further comprising a manifold near the rear end of the housing and comprising a primary conduit connectable to the primary fluid supply system and a secondary conduit connectable to the secondary fluid supply system.

30. The tool of claim 29 wherein the manifold comprises a manifold nut and wherein the inner wall of the rear end of the body coupling comprises internal threads to threadingly engage external threads on an outer wall of the manifold nut, such that a first end of the manifold nut is housed within the inner wall of the body coupling, the manifold nut being adapted to prevent rearward motion of the control sleeve beyond the reverse position of the control sleeve.

31. The tool of claim 27 wherein the body coupling further comprises an outer wall with external threads adapted to threadingly engage internal threads of the rear end of the housing.

32. The tool of claim 31 wherein the outer wall of the body coupling further comprises a plurality of slots milled along a longitudinal axis of the body coupling forming the exhaust conduit to permit passage of fluid.

33. The tool of claim 25 wherein the slidable engagement between the control sleeve and the valve chamber is adapted to permit angular deflection of the control sleeve within the valve chamber.

34. An impact-operated, ground-penetrating drilling assembly comprising:

a boring tool;

a fluid supply system adapted to supply pressurized fluid to power operation of the boring tool; and wherein the boring tool comprises:

a housing having a front end, a rear end, and body defining an interior operating chamber with an inner surface, an exhaust conduit providing communication between the operating chamber and the outside of the tool, a forward striker surface, and a rearward striker surface;

a striker reciprocally supported within the operating chamber of the housing between the forward and-rearward striker surfaces, the striker having a forward end, a rear portion terminating in a rear end, and a striker body defining an interior striker chamber, wherein the rear portion of the striker sealingly engages the inner surface of the operating chamber to divide the operating chamber into a forward operating chamber and a rearward operating chamber, the rearward operating chamber continuous with the exhaust conduit, wherein the striker body has at least one striker port to provide fluid communication between the forward operating chamber and the interior striker chamber;

a manifold near the rear end of the housing and comprising a primary conduit and a secondary conduit;

a primary fluid inlet tube extending from the primary conduit of the manifold;

a valve chamber configured to have a front valve chamber and a rear valve chamber, the rear valve chamber being in fluid communication with the secondary conduit in the manifold; and a means for controlling operation of the tool between a forward operating mode and a reverse operating mode.

* * * * *